United States Patent [19]

Negev

[11] Patent Number: 4,812,853

[45] Date of Patent: Mar. 14, 1989

[54] MICROSTRIP ANTENNA

[75] Inventor: Michael Negev, Rishon Le Zion, Israel

[73] Assignee: Elta Electronics Industry Limited, Israel

[21] Appl. No.: 905,483

[22] Filed: Sep. 8, 1986

[30] Foreign Application Priority Data

Sep. 9, 1985 [IL] Israel ..... 76342

[51] Int. Cl.[4] ..... H01Q 1/38

[52] U.S. Cl. ..... 343/700 MS

[58] Field of Search ..... 343/700 MS, 909, 751, 343/826

[56] References Cited

U.S. PATENT DOCUMENTS

| | | | |
|---|---|---|---|
| 4,218,682 | 7/1980 | Yu | 343/700 MS |
| 4,291,312 | 9/1981 | Kaloi | 343/700 MS |
| 4,369,447 | 1/1983 | Edney | 343/700 MS |
| 4,460,894 | 8/1984 | Robin et al. | 343/700 MS |
| 4,656,487 | 4/1987 | Sureau et al. | 343/872 |

OTHER PUBLICATIONS

Carrer, K & Mink, J, IEEE Transactions on Antennas and Propagation, vol. AP—29, No. 1, Jan. 1981, pp. 13 & 14.

Sanford, G. G., and Munson, R. E., A.P.S. International Symposium Conformal VHF Antenna for The Apollo—Soyuz Test Project, 10/76.

*Primary Examiner*—William L. Sikes
*Assistant Examiner*—Doris J. Johnson
*Attorney, Agent, or Firm*—Handal & Morofsky

[57] ABSTRACT

A multi-antenna element in the form of a narrow strip and including a dielectric substrate in the form of a narrow strip, a substantially continuous thin metallic layer coated onto one side of the dielectric substrate, at least one generally elongated discrete thin metallic layer coated onto the other side of the dielectric substrate and containing within its surface at least one void of predetermined location, size and shape, and each such void present in said discrete layer containing therewithin in noncontacting and in substantially coplanar relationship with the discrete layer at least one further discrete thin metallic coated layer of predetermined location, size and shape.

9 Claims, 1 Drawing Sheet

MICROSTRIP ANTENNA

FIELD OF THE INVENTION

The present invention relates to microwave antennas and more particularly to a multi-antenna element in the form of a narrow strip, as well as to a multi-antenna array containing such a strip.

BACKGROUND OF THE INVENTION

Various types of microwave antennas are known, including antennas which are laminated on dielectric strips. The prior art includes antennas with at most two different frequencies having opposite polarities.

SUMMARY OF THE INVENTION

The present invention seeks to provide a multi-element antenna of the laminated type having a plurality of operating frequencies at selectable polarities.

There is thus provided in accordance with the present invention a multi-antenna element in the form of a narrow strip and including a dielectric substrate in the form of a narrow strip, a substantially continuous thin metallic layer coated onto one side of the dielectric substrate, at least one generally elongated discrete thin metallic layer coated onto the other side of the dielectric substrate and containing within its surface at least one void of predetermined location, size and shape, and each such void present in said discrete layer containing therewithin in noncontacting and in substantially coplanar relationship with the discrete layer at least one further discrete thin metallic coated layer of predetermined location, size and shape.

It will be evident that the at least one generally elongated discrete thin metallic layer may be constituted by a single generally elongated discrete thin metallic layer, or alternatively it may be constituted by a plurality of such layers.

Moreover, the at least one void may be constituted by a single void, or alternatively it may be constituted by a plurality of voids. Preferably, the at least one void is constituted by two voids. Similarly, the at least one noncontacting and substantially coplanar further discrete thin metallic coated layer may be constituted by a single such layer, or alternatively it may be constituted by a plurality of such layers.

The elongated discrete layer or layers may be, for example, rectangular in shape. A similar remark applies to the void or voids, and to the noncontacting and substantially coplanar further discrete layer or layers. Nevertheless. as will be appreciated by those skilled in the art, the discrete layer(s). the void(s) and/or the noncontacting and substantially coplanar further discrete layer(s) may take other shapes, so long as they otherwise conform with the definitions given herein.

There is also provided in accordance with a further embodiment of the invention, a multi-antenna element in the form of a narrow strip and including a dielectric substrate in the form of a narrow strip, a substantially continuous thin metallic layer coated onto one side of the dielectric substrate, at least one elongated rectangular discrete thin metallic layer coated onto the other side of the dielectric substrate and containing within its surface two voids of predetermined location and size and of rectangular shape, each of the two voids present in the discrete layer containing therewithin in noncontacting and in substantially coplanar relationship with said discrete layer a further discrete thin metallic coated layer of predetermined location and size and of rectangular shape.

In this further embodiment, the at least one generally elongated rectangular discrete thin metallic layer may be constituted by a single generally elongated rectangular discrete thin metallic layer, or alternatively it may be constituted by a plurality of such layers. Moreover, each of the two voids located within a particular elongated rectangular discrete thin metallic layer may be of either identical or of different dimensions. It will also be appreciated that each of the two noncontacting and substantially coplanar further discrete thin metallic coated layers, contained within respective voids which are located within a particular elongated rectangular discrete thin metallic layer, may be of either identical or different dimensions.

In a different aspect, there is also provided by the invention a multi-antenna array including a multi-antenna element as described above, antenna connector means attached respectively to each generally elongated discrete thin metallic layer, being substantially coplanar therewith and having its longitudinal axis parallel with that of the strip, and antenna connector means attached respectively to each noncontacting substantially coplanar further discrete thin metallic coated layer and having its longitudinal axis substantially perpendicular thereto.

In a preferred embodiment, the invention provides a multi-antenna array including a multi-antenna element described above as a further embodiment of the invention, antenna connector means attached respectively to each generally elongated rectangular discrete thin metallic layer, being substantially coplanar therewith and having its longitudinal axis parallel with that of the strip, and antenna connector means attached respectively to each noncontacting substantially coplanar further discrete thin metallic coated layer and having its longitudinal axis substantially perpendicular thereto.

In accordance with the present invention, it is possible to save a considerable amount of space, and either an isolated microstrip or arrays of antennas can be constructed in a number of frequencies, within a strip or a small area of very limited dimensions.

A further advantage of the present invention is that is makes possible the construction of arrays of antennas, within a narrow strip, wherein each of the antennas may have different frequencies and different polarizations. It is moreover possible to harmonize the polarity of four antennas within an element at will and to work with a number of frequencies with different polarities and with high insulation, as required.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
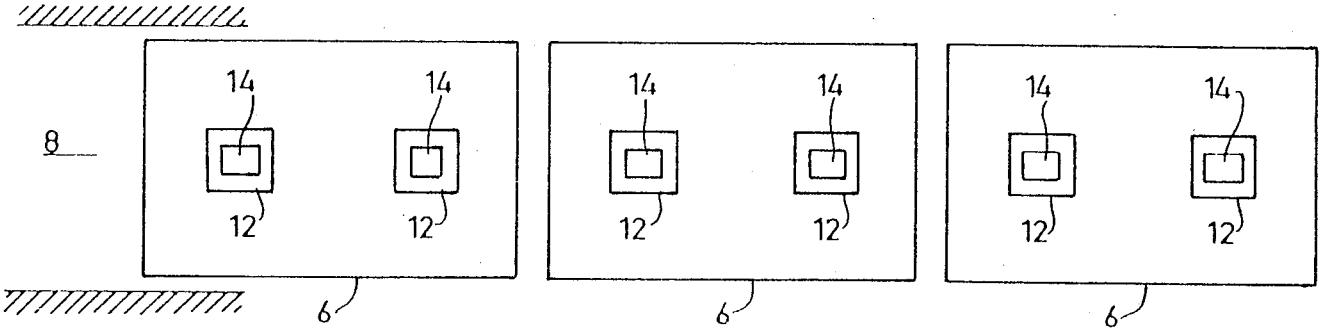
FIG. 1 shows an array of three (or more) elements constructed and operative in accordance with the invention.
Figure 2:
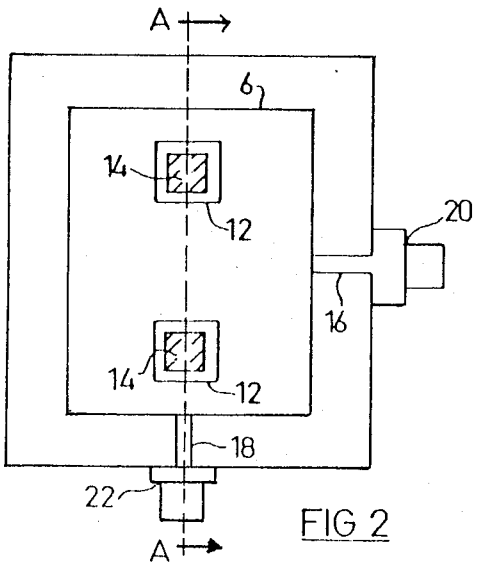
FIG. 2 shows four antennas having possibly different frequencies assembled in accordance with the invention.
Figure 3:
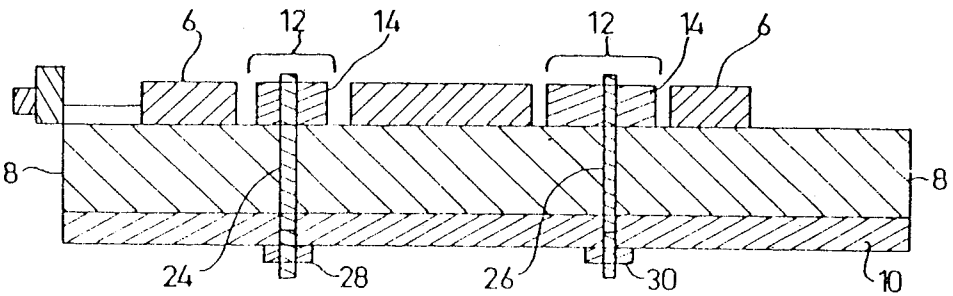
FIG. 3 illustrates a sectional view of the element of FIG. 2 taken along the line A—A.

Reference is now made to FIGS. 1–3 which illustrate one of a plurality of microstrip antenna elements containing separate antennas which could operate on four different frequencies.

A discrete thin conductive metallic layer element 6 is printed on a thin and narrow dielectric strip 8, which contains on its reverse side a continuous metallic layer 10 known as the ground plane. The material used in producing the antennas described herein is commercially available from Rogers, Inc. of Chanler, Ariz. U.S.A. under the trade name RT/Duroid 5880 and employs a Teflon-fiberglass dielectric substrate and a copper conductive layer.

Element 6 is rectangular and as shown it is printed with rectangular voids 12 within which are situated further rectangular discrete elements 14. Items 6, 12 and 14 could, however, equally take other shapes. It should be noted that the further discrete elements 14 within voids 12 are insulated from the rectangular elements 6—i.e. there is no electrical contact between the conductive surfaces 6 and 14.

Two elongate connector elements 16 and 18 are joined typically to the approximate mid-points of the respective long and short sides of the rectangular discrete elements 6, being substantially coplanar with the latter and so arranged that their longitudinal axes are approximately perpendicular to the respective sides of rectangle 6. The connector elements terminate in conventional antenna connectors 20 and 22 respectively.

As illustrated, additional connector elements 24 and 26 are joined directly to the two isolated elements 14 located within voids 12, the longitudinal axes of connector elements 24 and 26 being disposed approximately perpendicularly to the plane of elements 14. The connector elements 24 and 26 are insulated from ground plane 10 and terminate in conventional antenna connectors 28 and 30. It should be noted that all four antennas joined to a single microstrip are electrically insulated from each other.

As noted, FIGS. 2 and 3 illustrate a single multiantenna arrangement on a microstrip, while FIG. 1 illustrates a plurality of such arrays arranged on a single dielectric substrate.

While the invention has been particularly described and illustrated with respect to certain specific embodiments, it will be appreciated by those skilled in the art that many variations and modifications may be made. The invention is accordingly not limited to such embodiments as have been particularly described, but rather its scope is defined by the claims which follow.

I claim:

1. A multi-antenna array comprising:

a multi-antenna element in the form of a narrow strip and comprising:

a dielectric layer in the form of a narrow strip a substantially continuous thin metallic layer coated onto one side of the dielectric layer and defining a ground plane;

a plurality of generally elongated discrete thin metallic layer elements coated onto the other side of the dieleetric layer each containing within its surface a plurality of voids spaced from one another; at least one further discrete thin metallic coated layer element located witin each of said plurality of voids in noncontacting relationship with said elongated discrete metal layer element ; and antenna connector means attached respectively to each generally elongated discrete thin metallic layer and to each further discrete thin metallic coated layer element.

2. A multi-antenna array according to claim 1 and wherein the elongated discrete layers are rectangular in shape.

3. A multi-antenna array according to claim 1 and wherein the voids are rectangular in shape.

4. A multi-antenna array according to claim 1 and wherein the further discrete layers are rectangular in shape.

5. A multi-antenna array according to claim 1 wherein the two voids are of identical dimensions.

6. A multi-antenna array according to claim 1 wherein the two voids are of different dimensions.

7. A multi-antenna array according to claim 1 wherein the two further discrete thin metallic layer elements are of identical dimensions.

8. A multi-antenna array according to claim 1 wherein the two further discrete thin metallic layer elements are of different dimensions.

9. A multi-antenna array according to claim 1 and wherein said antenna connector means comprise:

coplanar antenna connector means attached to each generally elongated discrete thin metallic layer element, being substantially coplanar therewith and having its longitudinal axis parallel with that of the strip; and perpendicular antenna connector means attached respectively to each further discrete thin metallic coated layer and having its longitudinal axis substantially perpendicular thereto.

* * * * *